US006226844B1

(12) United States Patent
Lerra et al.

(10) Patent No.: US 6,226,844 B1
(45) Date of Patent: May 8, 2001

(54) QUICK RELEASE BUCKLES

(75) Inventors: Christopher G. Lerra, Manchester, NH (US); Stephen Stewart, Farmington; Mark Tauer, Sandy, both of UT (US)

(73) Assignee: Velcro Industries B.V., Antilles (NL)

( * ) Notice: Subject to any disclaimer, the term of this patent is extended or adjusted under 35 U.S.C. 154(b) by 0 days.

(21) Appl. No.: 09/320,473

(22) Filed: May 26, 1999

(51) Int. Cl.[7] ..... A44B 11/25; A44B 17/00

(52) U.S. Cl. ..... 24/625; 24/615; 24/616

(58) Field of Search ..... 24/625, 615, 616, 24/573.1

(56) References Cited

U.S. PATENT DOCUMENTS

| | | | | |
|---|---|---|---|---|
| D. 289,622 | | 5/1987 | Crowle et al. . | |
| D. 340,886 | | 11/1993 | Anscher . | |
| D. 343,144 | | 1/1994 | Matoba . | |
| 711,826 | | 10/1902 | Collins . | |
| 3,225,406 | * | 12/1965 | Levy | 24/616 |
| 3,313,135 | | 4/1967 | Reisner . | |
| 3,600,917 | | 8/1971 | Krock . | |
| 3,979,934 | | 9/1976 | Isenmann . | |
| 4,150,464 | | 4/1979 | Tracy . | |
| 4,389,759 | | 6/1983 | Yuda . | |
| 4,408,375 | | 10/1983 | Skobel . | |
| 4,559,679 | | 12/1985 | Downey . | |
| 4,577,374 | | 3/1986 | Lii . | |
| 4,679,282 | | 7/1987 | Feng . | |
| 4,688,337 | | 8/1987 | Dillner . | |
| 4,712,280 | | 12/1987 | Fildan . | |
| 4,793,032 | * | 12/1988 | Crowle | 24/615 |
| 4,802,262 | | 2/1989 | Kasai . | |
| 4,825,515 | | 5/1989 | Wolterstorff, Jr. . | |
| 4,831,694 | | 5/1989 | Kong . | |
| 4,864,700 | | 9/1989 | Kasai . | |
| 4,866,819 | | 9/1989 | Kasai . | |
| 4,894,890 | | 1/1990 | Kasai . | |
| 4,977,650 | | 12/1990 | Ida . | |
| 5,024,548 | | 6/1991 | Timmington . | |
| 5,148,582 | | 9/1992 | Dennis, Jr. . | |
| 5,170,539 | | 12/1992 | Lundstedt et al. | 24/196 |
| 5,222,279 | | 6/1993 | Frano et al. . | |
| 5,319,836 | * | 6/1994 | Ida | 24/616 |
| 5,380,067 | | 1/1995 | Turvill et al. . | |
| 5,380,238 | | 1/1995 | Crew-Gee . | |
| 5,427,562 | * | 6/1995 | Hwang | 24/615 |
| 5,438,737 | * | 8/1995 | Anscher et al. | 24/625 |

(List continued on next page.)

FOREIGN PATENT DOCUMENTS

| | | | | |
|---|---|---|---|---|
| 2328370 | * | 12/1974 | (DE) | 24/625 |
| 0 901 886 | | 3/1999 | (EP) . | |

OTHER PUBLICATIONS

Elizabeth Webbing Mills Literature, "DuPont Teflon® Fabric Protector on EWEB Webbing", two pages, No Date is Given.

Elizabeth Webbing Mills Literature, "Product Information Guide", four pages, No Date is Given.

Elizabeth Webbing Mills Literature, "Outdoor Applications Webbing", four pages, No Date is Given.

ITW Waterbury Brochure, Government Products, 52 pages, No Date is Given.

*Primary Examiner*—Victor N. Sakran
(74) *Attorney, Agent, or Firm*—Fish & Richardson P.C.

(57) ABSTRACT

Quick release buckles are provided that include, for example: (a) a first buckle component having an engagement end and a module receiving portion opposite the engagement end; and (b) a second buckle component having an engagement end constructed for releasable engagement with the engagement end of the first buckle component, and a module receiving portion opposite the engagement end; each of the module receiving portions being constructed for fixed engagement with any one of a plurality of different modular components. Methods of assembling buckling systems and buckle assembly systems are also provided.

26 Claims, 11 Drawing Sheets

U.S. PATENT DOCUMENTS 5,440,787 8/1995 Figueroa et al. ..... 24/50
5,471,716 * 12/1995 Takahashi ..... 24/615
5,542,161 8/1996 Anscher .
5,584,106 * 12/1996 Anscher ..... 24/625
5,659,931 8/1997 Anscher .
5,996,192 * 12/1999 Haines et al. ..... 24/615

* cited by examiner

QUICK RELEASE BUCKLES

BACKGROUND OF THE INVENTION

The invention relates to quick release buckles, and more particularly to side release buckles used to join webbing straps and other articles.

In applications such as backpacks and luggage, quick release buckles are used to fasten webbing straps together, allowing the buckle to be easily and quickly fastened and unfastened and, in some cases, providing adjustability of the length of the strap(s). In a backpack the quick release buckles are used, e.g., to fasten the belt of the pack around the wearer's waist, to fasten a sternum strap around the wearer's chest and, in some cases, to provide releasable, adjustable length compression straps along the sides of the pack. In luggage the buckles are used, e.g., to releasably secure a removable shoulder strap to a gym bag, duffle bag or briefcase.

A typical, previously known side release buckle 10 is shown in FIGS. 1 and 1A. It includes male component 12 and cooperating female component 14. To fasten the buckle, spring arms 16 of male component 12 are inserted into opening 18 of female component 14 (arrows A in FIG. 1), with center guide 13 sliding into center channel 15 (see FIG. 1C) to align the male and female components. The spring arms 16 expand into release openings 20 as the buckle is closed (FIG. 1A), with shoulder 17 of each spring arm engaging the edge 19 of the release opening. To release the buckle, the user presses the spring arms 16 together, to disengage them from release openings 20 and thereby allow the male and female components to separate (arrows B in FIG. 1A).

Side release buckle 10 includes webbing receiving portion 22 for receiving a webbing strap. One or both components of the buckle may include a pair of slots 22*a*, 22*b* separated by a bar 24, as shown on the male component in FIGS. 1 and 1A. As shown in FIG. 1D, to secure webbing strap 23, it is threaded through slot 22*a*, over the bar 24, back through slot 22*b* and under bar 26. The length of the strap can be adjusted by sliding the strap through the slots. If adjustability is not desired, one or both of the components may include a single slot 22*c*, as shown on the female component in FIGS. 1 and 1A. This allows a webbing strap to be threaded through the slot, folded back upon itself, and stitched in place, as shown in FIG. 1B (stitching 29).

SUMMARY OF THE INVENTION

The present invention features quick release buckles that include a standard buckle assembly including a first buckle component and a second buckle component that is releasably engageable with the first buckle component (e.g., a male component and a female component as described above). One or both of the buckle components includes a module-receiving portion that is constructed for attachment to any one of an assortment of interchangeable modular components. The ready interchangeability of the modular components also allows a single size of standard buckle assembly to be used in many different applications, with different types and sizes of web receiving portions, and with attachment devices such as snap hooks, hex rings and webbing dividers. For example, one of the buckle components can be attached to a modular component that has a web receiving portion sized to receive a first width of webbing and the other buckle component can be attached to a modular component that has a web receiving portion sized to receive a second, different width of webbing, allowing the quick release buckle to be used to join different widths of webbing. This modularity gives designers and manufacturers of articles that use quick release buckles great flexibility, without the need to specify and stock a large number of different types of quick release buckles. The manufacturer can simply inventory a supply of a single size of standard buckle assemblies and then purchase modular components as needed for different applications.

In one aspect, the invention features a quick release buckle that includes: (a) a first buckle component having an engagement end and a module receiving portion opposite the engagement end; and (b) a second buckle component having an engagement end constructed for releasable engagement with the engagement end of the first buckle component and a module receiving portion opposite the engagement end. Each of the module receiving portions is constructed for fixed engagement with any one of a plurality of different modular components.

Preferred quick release buckles include one or more of the following features. The module receiving portions are substantially identical to each other. The first and second buckle components are side release buckle components. Each module receiving portion includes an aperture constructed to receive a male portion of a modular component in an interference engagement. The fixed engagement is permanent.

In another aspect, the invention features a quick release buckle system that includes: (a) a standard buckle assembly including (i) a first buckle component having an engagement end and a module receiving portion opposite the engagement end; and (ii) a second buckle component having an engagement end constructed for releasable engagement with the engagement end of the first buckle component and a module receiving portion opposite the engagement end; and (b) a plurality of modular functional components, each modular component having a first end constructed for engagement with the module receiving portion and a second, opposite fastening end, at least some of the fastening ends being different from each other.

Preferred quick release buckle systems include one or more of the following features. The module receiving portions are substantially identical to each other. The first and second buckle components are side release buckle components. Each module receiving portion includes an aperture constructed to receive a male portion extending from the first end of the modular component in an interference engagement. The fixed engagement is permanent. Each first end of each of the plurality of modular components is substantially identical to every other first end. The fastening end of the modular component includes a functional portion selected from the group consisting of web-receiving slots, hex rings, webbing dividers and snap hooks.

In yet another aspect, the invention features a quick release buckle that includes: (a) a first buckle component having an engagement end and a module receiving portion opposite the engagement end; and (b) a second buckle component having an engagement end constructed for releasable engagement with the engagement end of the first buckle component. The module receiving portion of the first buckle is constructed for fixed engagement with any one of a plurality of different modular components.

The invention also features methods of assembly of a buckling system. Preferred methods include: (a) providing a standardized buckle having at least one side constructed to receive a modular functional component, (b) providing a set of modular functional components having engaging structure constructed to engage the side of the standardized buckle, (c) selecting a modular functional component from the set, and (d) assembling the modular functional component with the standardized buckle.

Preferred methods may include one or more of the following features. Each individual member of the set of modular functional components includes a functional portion selected from the group consisting of web-receiving slots, hex rings, webbing dividers and snap hooks. The set of modular functional components includes members having different functional portions. The standardized buckle is a quick release buckle, e.g., a side release buckle.

In another aspect, the invention features a buckle assembly system including: (a) a supply of standardized buckles having at least one side constructed to receive a modular functional component, and (b) a supply of modular functional components, including components having different functions, each modular functional component having engaging structure constructed to engage a portion of a respective standardized buckle.

In preferred embodiments, the system includes one or more of the following features. The engaging structure of each modular functional component is substantially identical to the engaging structure of each other modular functional component. The standardized buckle is a quick release buckle. The supply of modular functional components includes modular functional components having a functional portion selected from the group consisting of web-receiving slots, hex rings, webbing dividers and snap hooks.

The term "quick release buckle", as used herein, includes side release and center release buckles, and other buckles that include opposed, releasably engagable buckle components.

The term "fixed engagement", as used herein, means engagement which does not allow any significant amount of relative rotation of the engaged parts.

Other features and advantages of the invention will be apparent from the following description of a presently preferred embodiment, and from the claims.

BRIEF DESCRIPTION OF THE DRAWINGS

In FIG. 7A, a webbing strap including a hex ring is threaded through the webbing receiving portion.

DESCRIPTION OF THE PREFERRED EMBODIMENTS

Figure 2:
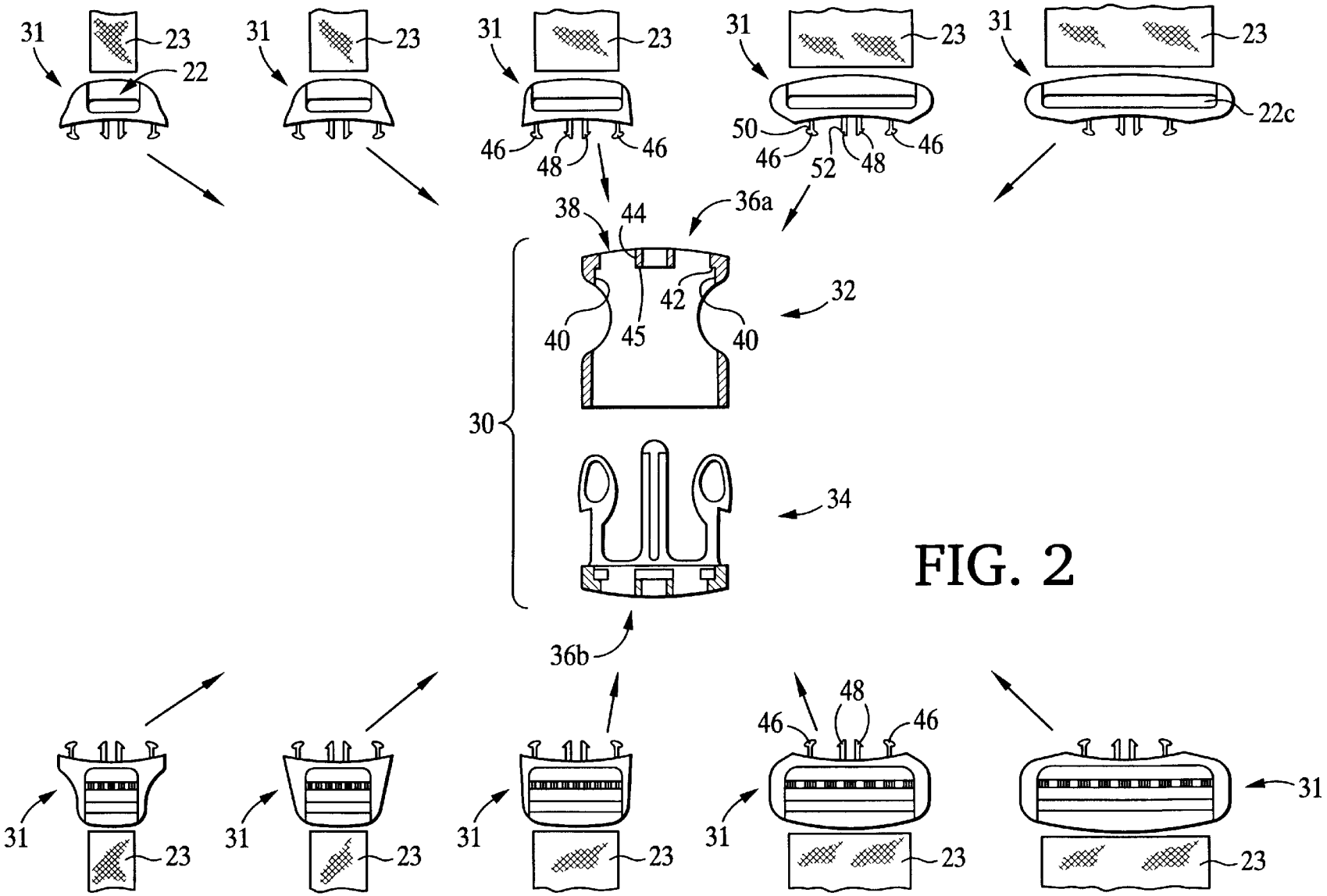
FIG. 2 is an exploded view, in partial cross-section, of a quick release buckle system according to one embodiment of the invention, showing a standardized buckle assembly and a number of selectable cooperating modular components having different functions.
Figure 2A:
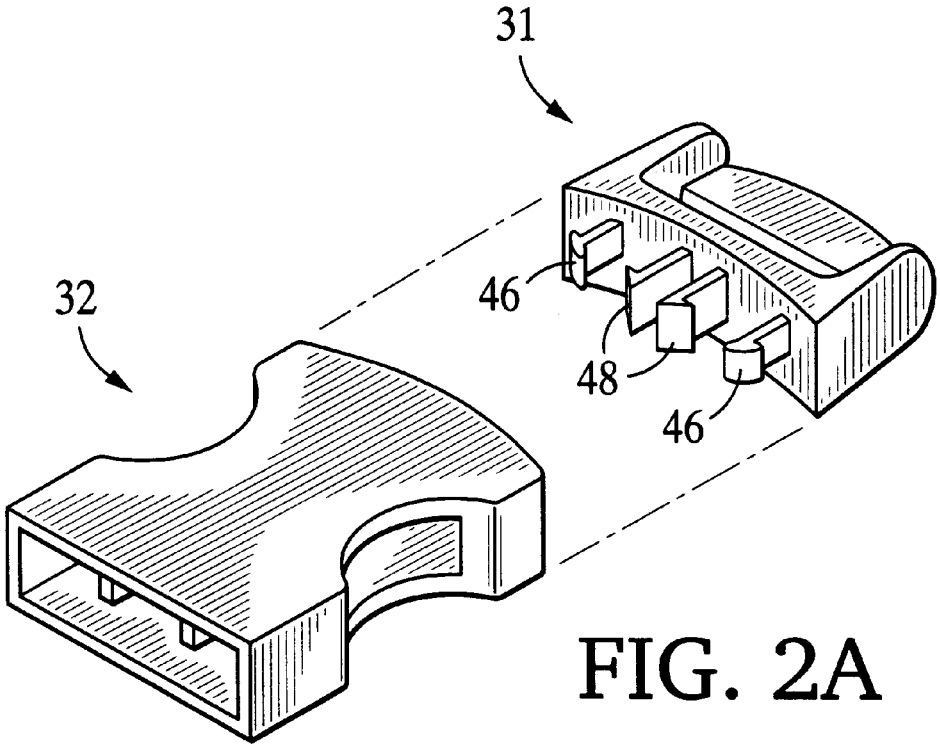
FIGS. 2A and 2B are perspective views, taken from opposite directions, showing the female portion of the standardized buckle assembly and a cooperating modular component.
Figure 2B:
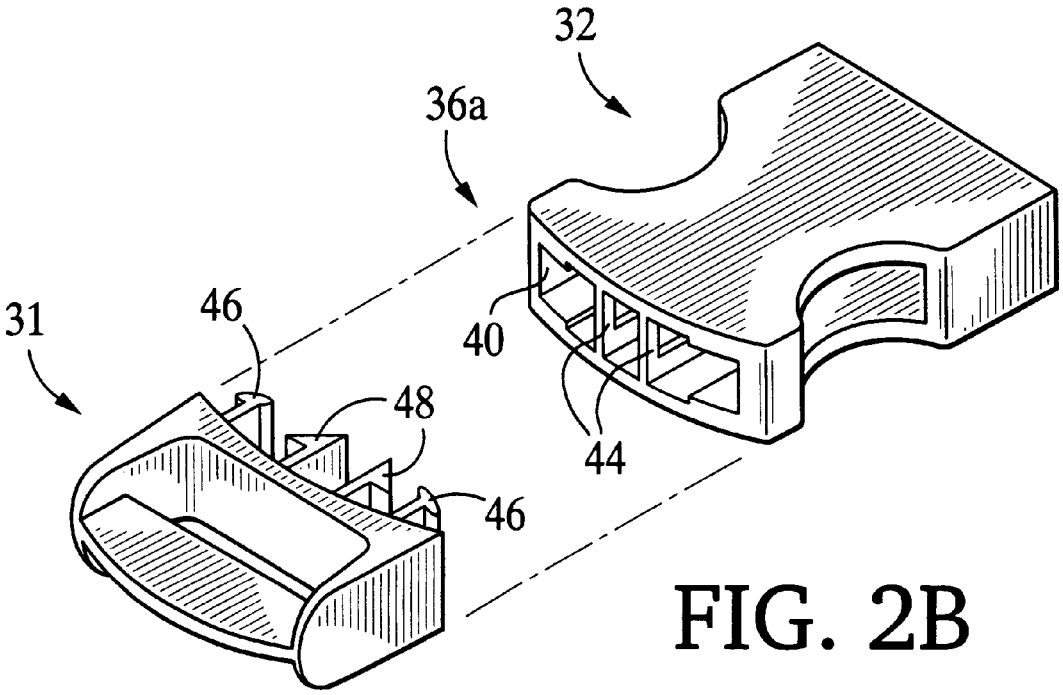

A quick release buckle system according to one embodiment of the invention is shown in FIG. 2. The system includes a standardized buckle assembly 30, and ten selectable, different modular components 31 constructed to receive different widths of webbing 23 (shown in FIG. 2 prior to being threaded through the webbing receiving portions 22 of the modular components 31). Any one of these modular components 31, as well as similar modular components constructed for other functions, can be engaged with either of the buckle components, as discussed below.

Figure 1:
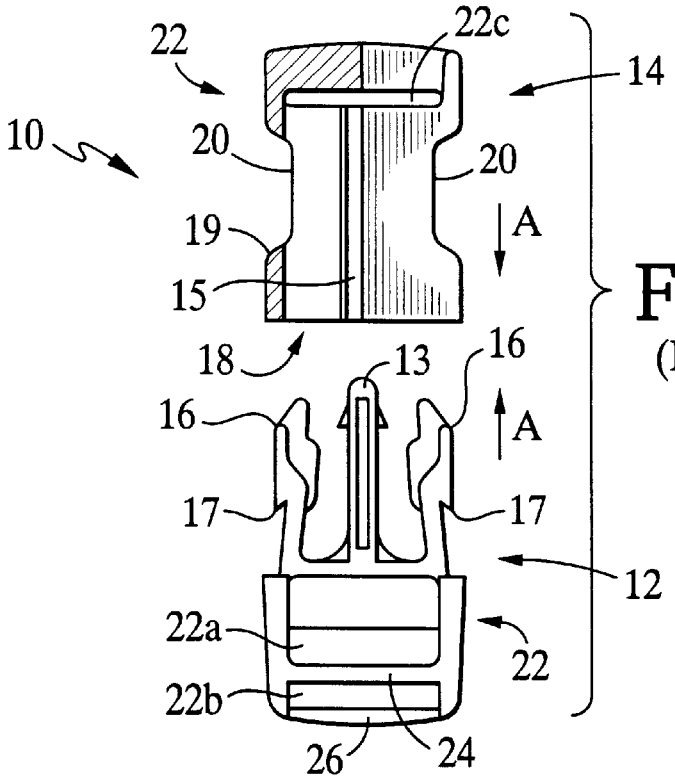
FIG. 1 (Prior Art)
FIG. 1 is an exploded view of a prior art side release buckle, in partial cross-section.
Figure 1A:
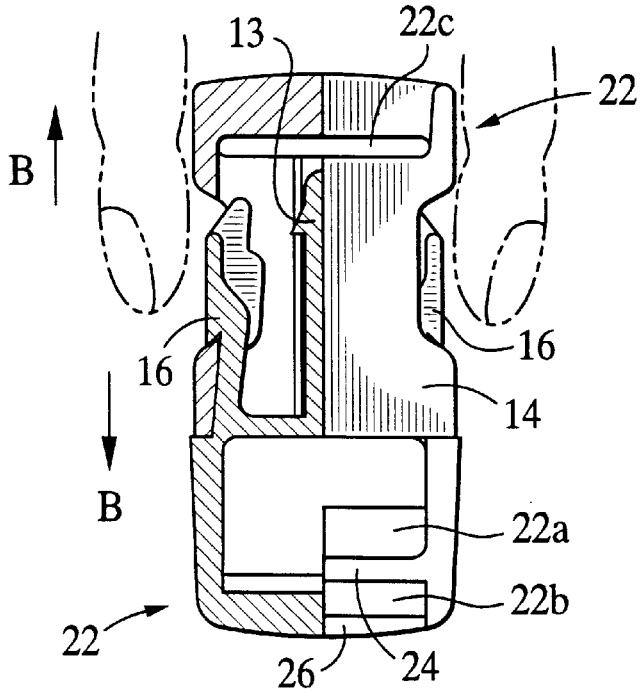
FIG. 1A (Prior Art)
FIG. 1A is a plan view of the buckle of FIG. 1, in partial cross-section, showing the buckle being released by a user.
Figure 1B:
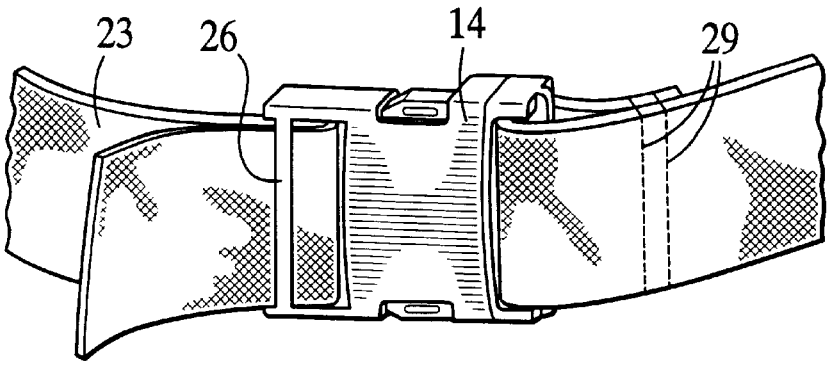
FIG. 1B (Prior Art)
FIG. 1B is a perspective view of a side release buckle of the prior art joining two pieces of webbing.
Figure 1C:
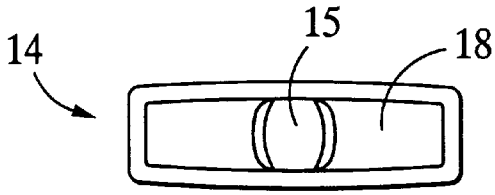
FIG. 1C (Prior Art)
FIG. 1C is an end view of the female portion of the prior art side release buckle.
Figure 1D:
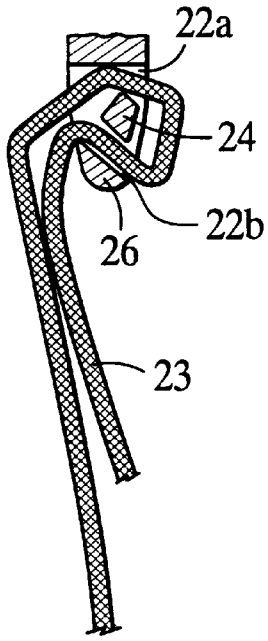
FIG. 1D is a side cross-sectional view of the web-receiving portion of the male component, showing a webbing strap threaded through it.

The standardized buckle assembly 30 includes female buckle component 32 and male buckle component 34. Male buckle component 34 is constructed for releasable engagement with the female buckle component 32 in the manner described above with reference to FIGS. 1 and 1A, i.e. the male and female buckle components are of the "side release" type.

Each of the buckle components 32, 34, includes a module-receiving structure 36*a*, 36*b*. The two module receiving structures are identical, so that they are constructed to receive modular components that have the same engagement structure. Each module-receiving structure includes an open end 38, opposed side walls 40, each including a lip 42, and a central formation 44 that defines lips 45 at the sides facing the respective side walls.

Each of the modular components 31 includes a pair of outer locking posts 46 and a pair of central locking posts 48.

Figure 3:
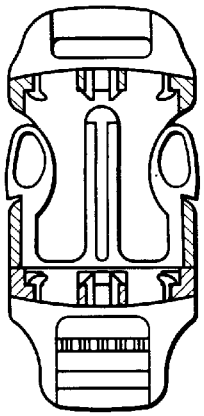
FIGS. 3–3D are plan views, in partial cross-section, of the standardized quick release buckle of FIG. 2, assembled with selected modular components of FIG. 2, to join respective webbings of the same width.
Figure 3A:
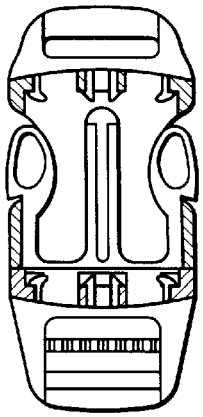
Figure 3B:
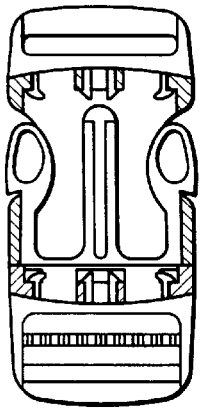
Figure 3C:
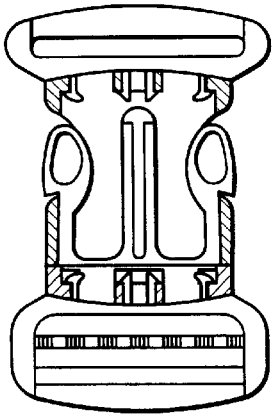
Figure 3D:
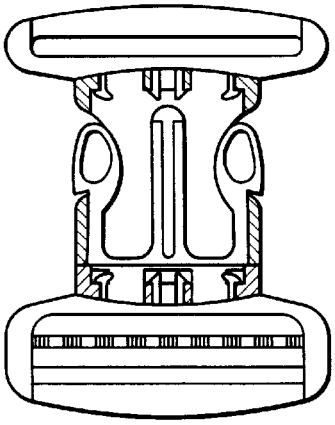

Each outer locking post 46 includes a shoulder 50 constructed to engage lip 42 of the module receiving end, and each central locking post 48 includes shoulder 52 constructed to engage lip 45 of the central formation 44 (see FIGS. 3–3D). When the locking posts of a selected module are inserted into the open end 38 of the male or female component 32 or 34 of a standardized buckle, shoulders 50 and 52 engage lips 42 and 45, respectively, to provide a secure, permanent fixed engagement between the modular component 31 and the buckle component 32 or 34. The provision of the set of outer and central locking posts results in a strong connection that prevents rotation of the modular component relative to the buckle component.

As shown in FIGS. 3–3D, the modularity of the buckle system allows a single size of standardized buckle to be used with modular components that are sized to receive a wide variety of webbing widths, e.g., from narrower than the width of the buckle (FIG. 3) to wider than the width of the buckle (FIG. 3D).

Figure 4:
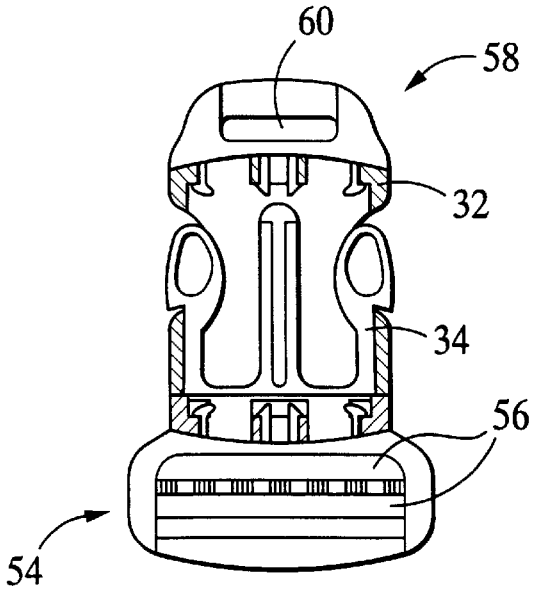
FIG. 4 is a plan view, in partial cross-section, of the standardized quick release buckle assembled with selected modular components of FIG. 2 to join webbing of different widths.

As shown in FIG. 4, the modularity of the buckle system allows different widths of webbing to be joined. In the example shown in FIG. 4, a first modular component 54, mounted on male buckle component 34, includes two relatively wide webbing-receiving slots 56, while a second modular component 58, mounted on female buckle component 32, includes a relatively narrow webbing-receiving slot 60. Any desired combination of webbing widths can be obtained in similar fashion by interchanging modular components.

Figure 5:
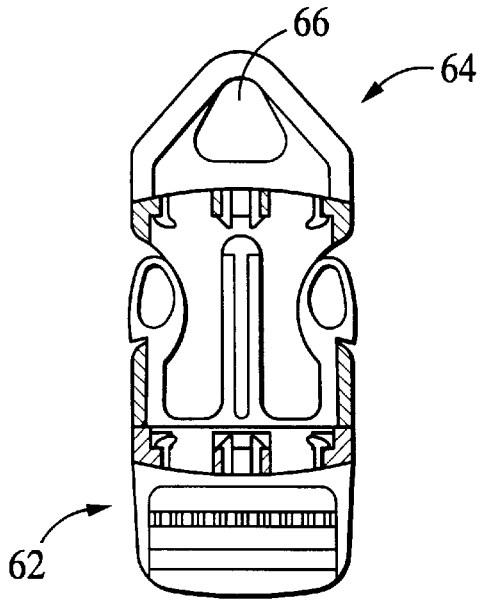
FIG. 5 is a plan view, in partial cross-section, of the standardized quick release buckle assembled with a modular component having a webbing receiving portion and a modular component having a hex ring.
Figure 6:
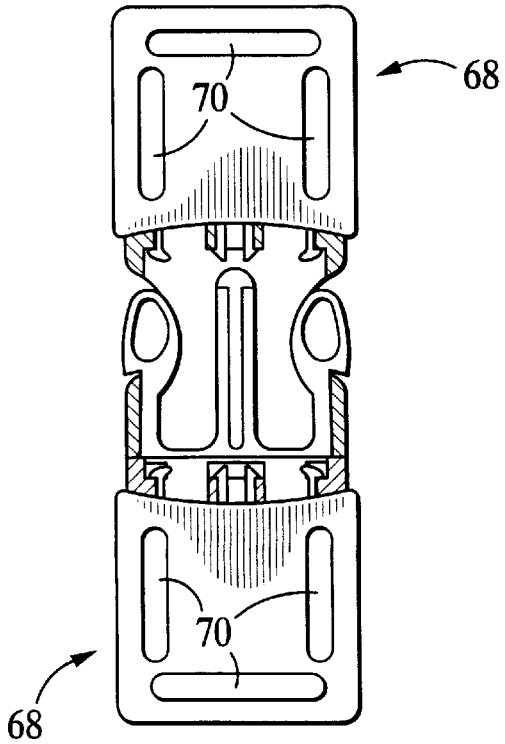
FIGS. 6 and 6A are plan views, in partial cross-section, of the standardized quick release buckles assembled with modular components having different types of webbing dividers.
Figure 6A:
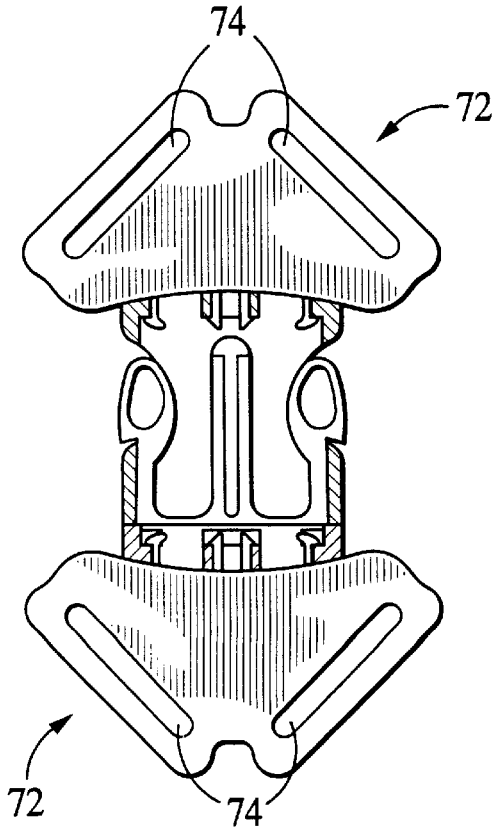
Figure 7:
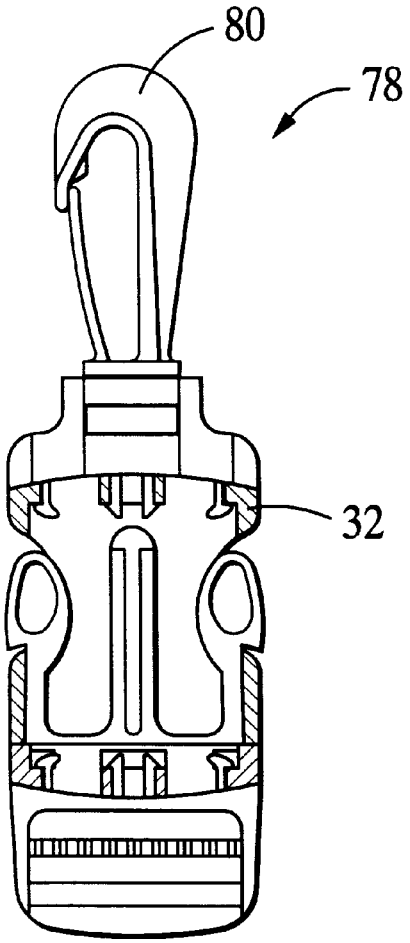
FIGS. 7 and 7A are plan views, in partial cross-section, of the standardized quick release buckle assembled with modular components that have a snap hook and a webbing receiving portion, respectively.
Figure 7A:
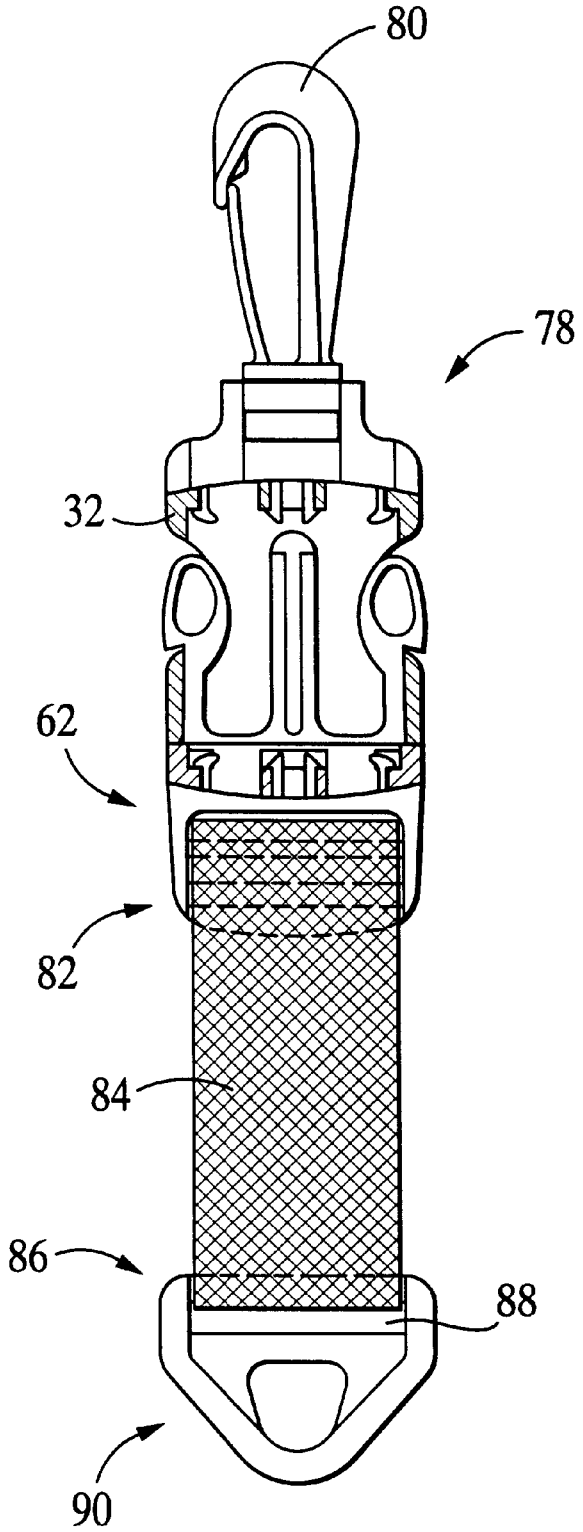

FIGS. 5–7A illustrate buckles including modular components having various functions. In FIG. 5, the buckle joins a first, webbing-receiving modular component 62 with a second modular component 64 that includes a hex ring 66, e.g., for engagement with a snap hook. In FIGS. 6 and 6A, the buckle joins first and second modular components that each include webbing dividers, e.g., for joining webbing straps entering the clip from different directions. Webbing dividers 68 (FIG. 6) include three webbing-receiving openings 70 positioned to receive webbing straps at 0°, 90° and 180°, while webbing dividers 72 (FIG. 6A) include two webbing-receiving openings 74, positioned to receive webbing straps at approximately 45° and 135°. In FIGS. 7 and 7A, the female buckle component 32 is joined to a modular component 78 that includes a snap hook 80, and the male buckle component 34 is joined to a webbing-receiving modular component 62 as shown in FIG. 5. In FIG. 7A, a first end 82 of a length of webbing 84 is threaded through the modular component 62, and a second end 86 of the webbing 84 is threaded through slot 88 of hex ring 90. The combinations shown in FIGS. 4–7A are merely a few examples of the many possible combinations of modular components.

Figure 8:
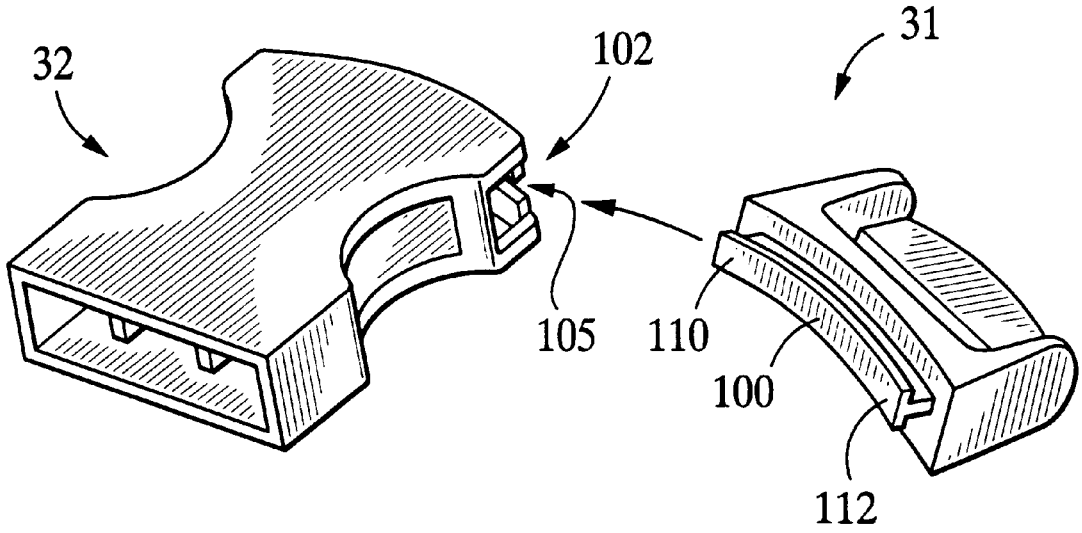
FIGS. 8 and 8A are perspective views, taken from opposite directions, showing a standardized buckle component and a cooperating modular component according to an alternate embodiment of the invention.
Figure 8A:
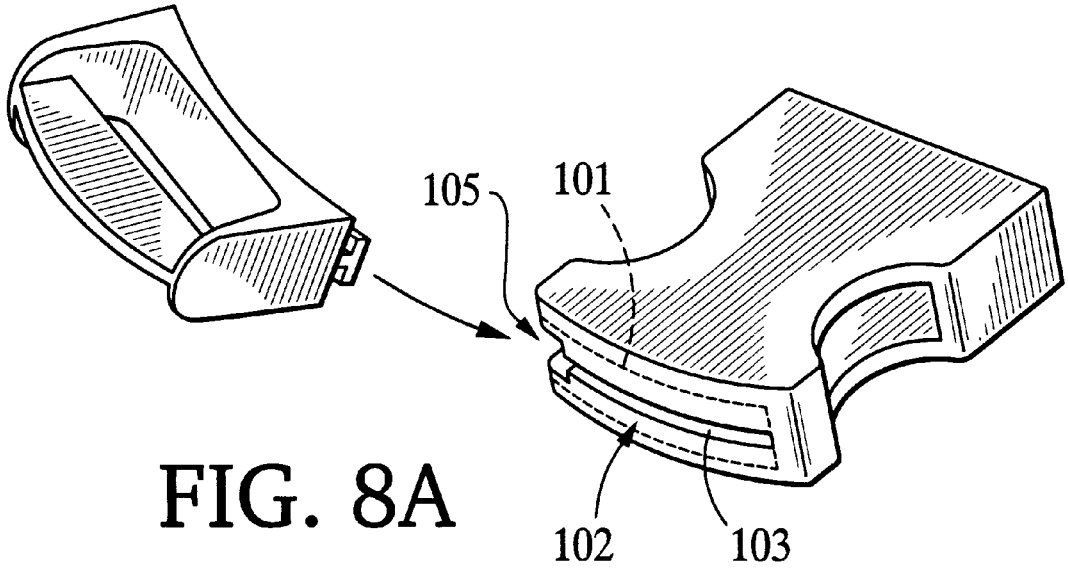
Figure 8B:
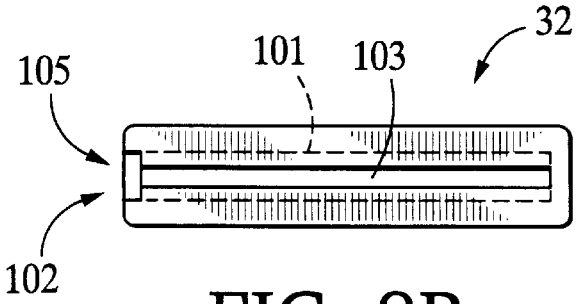
FIGS. 8B and 8C are end views of, respectively, the standardized buckle female component and the modular component.
Figure 8C:
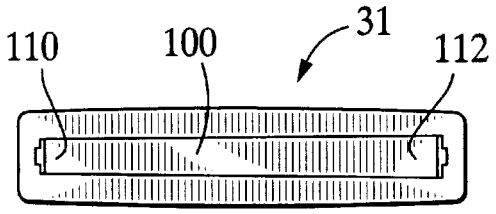
Figure 8D:
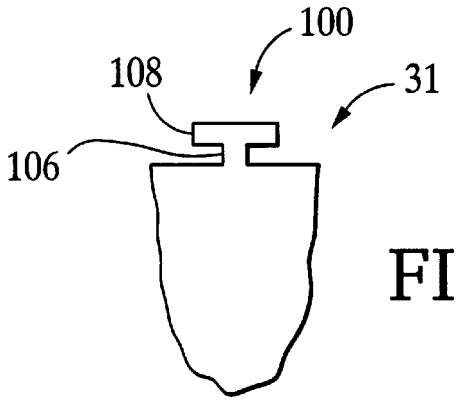
FIG. 8D is an enlarged end view of the modular component.
Figure 8E:
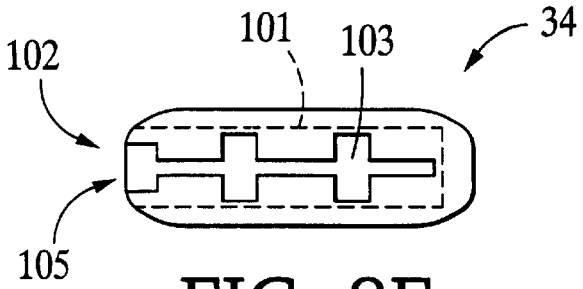
FIG. 8E is an end view of the standardized buckle male component.
Figure 9:
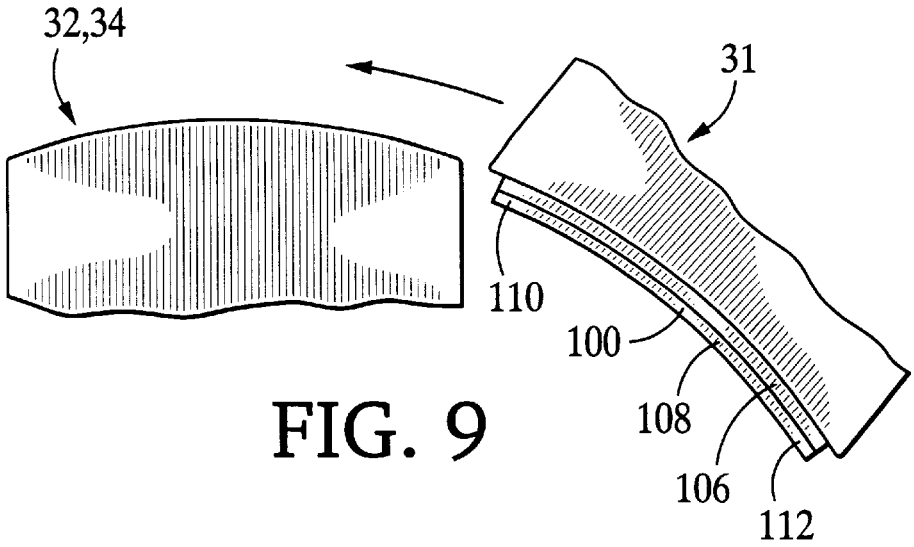
FIGS. 9–9B are partial plan views showing the buckle and modular components of FIG. 8 before, during and after assembly.
Figure 9A:
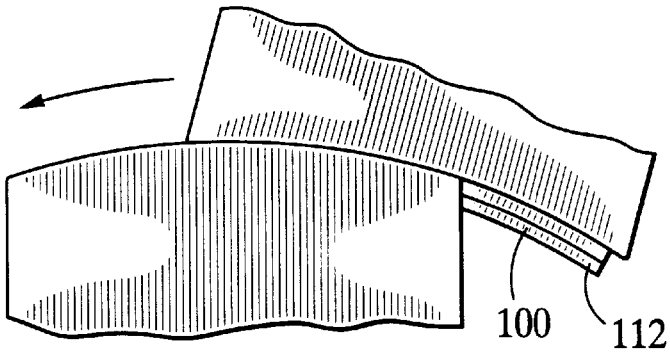

The modular components may be assembled with the standardized buckle in other suitable ways. For example, enhanced strength is provided by the tongue-and-groove engagement that is shown in FIGS. 8–10A. An elongated bar 100 is provided on the modular component 31, and a receiving slot 102 dimensioned to receive the bar 100 is provided on the standardized buckle 32. (While female buckle component 32 is shown for purposes of illustration, the same tongue20 and-groove engagement may be used with male buckle component 34). The elongated bar 100 is t-shaped in cross-section, i.e., it includes a base member 106 and a cross-bar 108 (see FIG. 8D). The width of the cross-bar 108 tapers slightly along its length, from narrow end 110 to wide end 112, so that one end is slightly wider than the other end, e.g., about 10–20% wider, more preferably about 15% wider. Receiving slot 102 includes a surface channel 103, having a width sufficient to allow the base member 106 to slide freely along its length, and an interior channel 101 that is sufficiently wide to receive the cross-bar 108 in sliding engagement (see FIGS. 9–9B). Thus, the width of channel 101 is slightly larger than the width of the wide end of cross-bar 108. Receiving slot 102 also includes an end opening 105 that is narrower than the wide end of cross-bar 108, e.g., by about 5–10%, more preferably about 7%. When crossbar 108 slides into receiving slot 102, as shown in FIGS. 9–9A, end opening 105 must deflect slightly so that the wide end 112 (which is wider than opening 105) can pass through into interior channel 101. Once wide end 112 has passed through end opening 105, the walls of the end opening return to their normal position. In this position, the walls of end opening 105 overlap the wide end of the cross-bar, thus acting as a detent that prevents the cross-bar 108 from being withdrawn from interior channel 101. Suitable dimensions for the cross-bar are, e.g., 4.1 mm at the narrow end 110, increasing to 4.8 mm at the wide end 112. A suitable width for the interior channel would be, e.g., approximately 5.0 mm, with the end opening 105 having an undeflected width of approximately 4.5 mm. When the tongue-and-groove engagement is used with a male buckle component, for molding purposes it may be desirable to alter the shape of the surface channel 103 to that shown in FIG. 8E so that the interior channel 101 can be formed more easily.

Figure 9B:
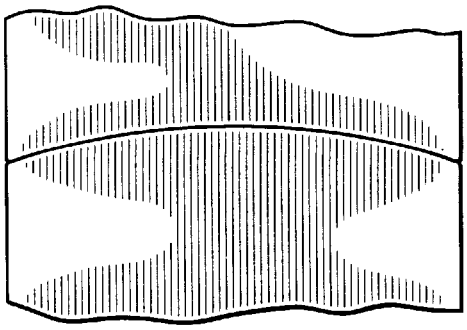
Figure 10A:
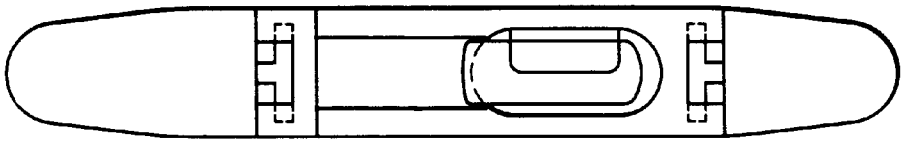
FIGS. 10 and 10A are front and side plan views, respectively, of the buckle and modular components of FIG. 9 in their assembled state.
Figure 10:
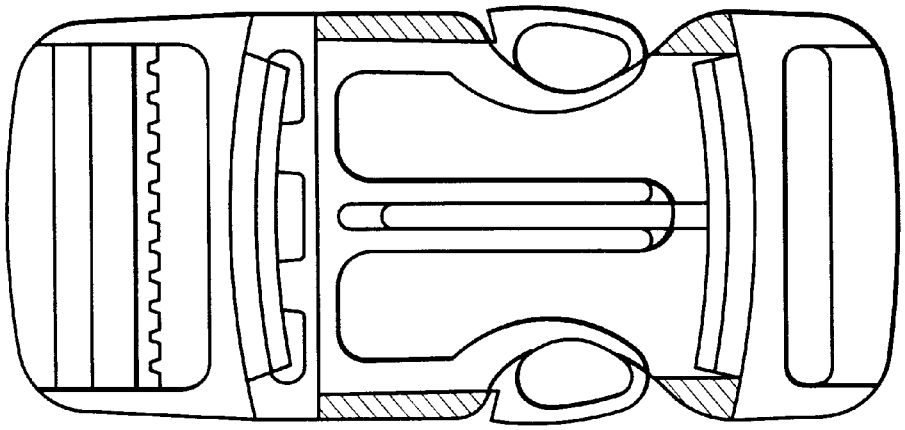

As shown in FIGS. 9–9B, the buckle and modular component are assembled by sliding the bar 100 into the receiving slot 102 until the buckle and modular component are aligned and wide end 112 is locked in place behind end opening 105. The assembled buckle and modular component are shown in FIGS. 10 and 10A, with the dotted lines in FIG. 10A indicating the overlap of cross-bar 108 with the walls of end opening 105.

If desired, the positions of the bar and receiving slot can be reversed, i.e., the buckle can include the bar 100 and the modular component can include the slot 102.

Other embodiments are within the claims.

For example, while the invention has been discussed above in the context of side release buckles, the releasably engageable portions of a standardized buckle could be of any desired type, e.g., center release buckles or buckles having a half-twist locking mechanism.

Moreover, while in the preferred embodiments discussed above the buckle components include an open end and the modular components include prongs (i.e., the buckle components are "female" and the modular components are "male"), employing broad aspects of the invention, the reverse construction can be employed. In fact, employing broader aspects of the invention, any desired method of attachment can be used, provided that attachment can be performed relatively easily and that adequate strength and performance properties are provided. Likewise, when modular components are attached to the buckle components using an automated process, in the factory, the components may be joined in any suitable manner, such as various types of interference engagement, e.g., the parts may be press fit and subsequently ultrasonically welded. Other suitable methods of attachment include adhesive bonding and vibration welding, e.g., ultrasonic welding.

While the engagement of the modular component with the buckle component is permanent in the embodiments described above, employing broader aspects of the invention the standardized buckle and the modular components can be constructed to releasably engage.

Also, while both the male and female buckle component shown and described above are constructed to receive a modular component, in some embodiments only one of the buckle components will include this feature.

What is claimed is:

1. A quick release buckle, comprising:

a first buckle component having an engagement end and a module receiving portion opposite the engagement end;

a second buckle component having an engagement end constructed for releasable engagement with the engagement end of the first buckle component, and a module receiving portion opposite the engagement end;

each of said module receiving portions being constructed for fixed engagement with any one of a plurality of different modular components, at least some of the different modular components having web-receiving slots of different widths to receive webbing of different widths.

2. The quick release buckle of claim 1 wherein the module receiving portions are substantially identical to each other.

3. The quick release buckle of claim 1 wherein said first and second buckle components are side release buckle components.

4. The quick release buckle of claim 1 wherein each said module receiving portion includes an aperture constructed to receive a male portion of a modular component in an interference engagement.

5. The quick release buckle of claim 1 wherein said fixed engagement is permanent.

6. The quick release buckle of claim 1 wherein said fixed engagement is provided by tongue-in-groove engagement of the module receiving portion with a modular component.

7. The quick release buckle of claim 1 wherein said fixed engagement is provided by sliding engagement of a bar within a channel, removal of the bar from the channel being prevented by a detent at an open end of said channel.

8. A quick release buckle system, comprising:

(a) a standard buckle assembly comprising:

a first buckle component having an engagement end and a module receiving portion opposite the engagement end;

a second buckle component having an engagement end constructed for releasable engagement with the engagement end of the first buckle component, and a module receiving portion opposite the engagement end; and (b) a plurality of different modular functional components, each modular component having a first end constructed for fixed engagement with said module receiving portion and a second, opposite fastening end, at least some of said fastening ends being different from each other, at least some of the different modular components having web-receiving slots of different widths to receive webbing of different widths.

9. The quick release buckle system of claim 8 wherein the module receiving portions are substantially identical to each other.

10. The quick release buckle system of claim 8 wherein said first and second buckle components are side release buckle components.

11. The quick release buckle system of claim 8 wherein each said module receiving portion includes an aperture constructed to receive a male portion extending from said first end of said modular component in an interference engagement.

12. The quick release buckle system of claim 8 wherein said fixed engagement is permanent.

13. The quick release buckle system of claim 8 wherein each first end of each of said plurality of modular components is substantially identical to every other first end.

14. The quick release buckle system of claim 8 wherein said fastening end of said modular component includes a functional portion selected from the group consisting of web-receiving slots, hex rings, webbing dividers and snap hooks.

15. The quick release buckle system of claim 8 wherein said engagement end of said modular component includes a bar and said engagement end of said buckle component includes a slot dimensioned to receive said bar in sliding engagement.

16. The quick release buckle system of claim 15 wherein said slot includes a detent for restricting sliding movement of said bar after its insertion into said slot.

17. A quick release buckle, comprising:

a first buckle component having an engagement end and a module receiving portion opposite the engagement end;

a second buckle component having an engagement end constructed for releasable engagement with the engagement end of the first buckle component;

said module receiving portion being constructed for fixed engagement with any one of a plurality of different modular components, at least some of the different modular components having web-receiving slots of different widths to receive webbing of different widths.

18. A method of assembly of a buckling system including:

providing a standardized buckle having at least one side constructed to receive a modular functional component, providing a set of modular functional components having engaging structure constructed to engage said side of said standardized buckle in fixed engagement, at least some of the modular components having web-receiving slots of different widths to receive webbing of different widths, selecting a modular functional component from said set, and assembling the modular functional component with the standardized buckle.

19. The method of claim 18 wherein each individual member of said set of modular functional components includes a functional portion selected from the group consisting of web-receiving slots, hex rings, webbing dividers and snap hooks.

20. The method of claim 19 wherein said set of modular functional components includes members having different functional portions.

21. The method of claim 19 wherein said standardized buckle is a quick release buckle.

22. The method of claim 21 wherein said quick release buckle is a side release buckle.

23. A buckle assembly system comprising:

a supply of standardized buckles having at least one side constructed to receive a modular functional component in fixed engagement, and a supply of modular functional components, including components having different functions, at least some of the modular components having web-receiving slots of different widths to receive webbing of different widths, each modular functional component having engaging structure constructed to engage a portion of a respective standardized buckle.

24. The system of claim 23 wherein the engaging structure of each modular functional component is substantially identical to the engaging structure of each other modular functional component.

25. The system of claim 23 wherein said standardized buckle is a quick release buckle.

26. The system of claim 23 wherein said supply of modular functional components includes modular functional components having a functional portion selected from the group consisting of web-receiving slots, hex rings, webbing dividers and snap hooks.

* * * * *